US005791819A

United States Patent [19]

Christiansen

[11] Patent Number: 5,791,819

[45] Date of Patent: Aug. 11, 1998

[54] BUOYANT PLATFORM

[75] Inventor: Poul-Eric Christiansen, Surrey, England

[73] Assignee: Kaerner AS, Oslo, Norway

[21] Appl. No.: 676,399

[22] PCT Filed: Jan. 20, 1995

[86] PCT No.: PCT/NO95/00016

§ 371 Date: Aug. 19, 1996

§ 102(e) Date: Aug. 19, 1996

[87] PCT Pub. No.: WO95/19911

PCT Pub. Date: Jul. 27, 1995

[30] Foreign Application Priority Data

Jan. 21, 1994 [GB] United Kingdom ..... 9401141

[51] Int. Cl.[6] ..... B63B 35/44

[52] U.S. Cl. ..... 405/224; 405/223.1; 405/205; 114/265

[58] Field of Search ..... 405/203, 204, 405/205, 206, 207, 209, 219, 223.1, 200, 224; 114/264, 265, 266

[56] References Cited

U.S. PATENT DOCUMENTS

| | | | |
|---|---|---|---|
| 3,986,471 | 10/1976 | Haselton | 114/265 |
| 4,167,148 | 9/1979 | Fayren . | |
| 4,471,708 | 9/1984 | Wilson et al. | 114/265 |
| 4,729,695 | 3/1988 | Silvestri | 405/209 X |
| 4,823,719 | 4/1989 | Sarwe | 114/265 X |
| 5,292,207 | 3/1994 | Scott | 405/207 |

FOREIGN PATENT DOCUMENTS

| | | |
|---|---|---|
| 23 49 879 | 4/1975 | Germany . |
| 2 207 892 | 2/1989 | United Kingdom . |

OTHER PUBLICATIONS 87-333556/47 Derwent's abstract of SU-1303-486 SU-869,801 of 15 Apr. 1987.

*Primary Examiner*—Tamara L. Graysay
*Assistant Examiner*—Frederick L. Lagman
*Attorney, Agent, or Firm*—Merchant, Gould, Smith, Edell, Welter and Schmidt

[57] ABSTRACT

A floating platform comprising in combination a semisubmersible vessel (40) having two or more pontoons, buoyant columns upstanding from those pontoons and a deck supported on the columns (the semisubmersible vessel being a kind known per se); and a raft (41) comprising a hull portion and two or more buoyant caissons arranged so that the raft is capable of floating in a stable configuration with the hull portion of the raft submerged to such a depth that the semi submersible vessel (40) can float over the hull portion and with only the buoyant caissons piercing the water surface, in which the pontoons of the semisubmersible vessel (40) are secured to upper surfaces of the hull of the raft (41).

8 Claims, 2 Drawing Sheets

BUOYANT PLATFORM

The invention relates to a buoyant platform, and to a method of assembling such a platform.

In particular the invention relates to a buoyant platform formed from an existing semisubmersible vessel secured to an upper surface of a purpose built raft.

Semisubmersible vessels have been used for some years in the offshore industry for the purpose of drilling, production and marine operations. These semisubmersible vessels typically have two parallel spaced apart pontoons with buoyant columns upstanding from those pontoons to support a deck. In transit the vessel is deballasted so that it can float on the pontoons with the columns clear of the water. This allows the vessel to operate as a catamaran. For activities which require a stable offshore platform, the vessel is ballasted down so that the pontoons are submerged, and only the buoyant columns pierce the water surface—thus giving the vessel a substantial buoyancy with a small waterplane area.

This configuration—which is illustrated in U.K. Patent Specification 2068439A—provides a more stable platform for offshore operations than would be provided by a conventional ship shaped vessel. However, for severe seastates, even the semisubmersible vessel becomes subject to movements which are unacceptable for many offshore operations, including inter alia drilling and production. This leads to "downtime" during which all the costs of operating the semisubmersible vessel are incurred, but no useful work is done.

Economic development of offshore oil and gas fields in hostile areas (in terms of severe sea states) has led to requirements for drilling, production and marine operations to be carried out in progressively more severe sea states, so to minimise downtimes.

It is known from USSR Certificate of Authorship SU 1303486 to use a ballasted double float with platform as lifting equipment for the assembly or repair of a semisubmersible drilling rig. The ballastable double float with platform may be regarded as a controllably buoyant structure. The ballastable double float with platform is located under the semisubmersible drilling rig, and is then deballasted to lift that semisubmersible drilling rig clear of the water for assembly or repair. This combination is located using anchor chains deployed directly from the semisubmersible drilling rig. This suffers from the disadvantage that the operations can only be carried out in calm water over a limited period of time. For this reason the combination of the semisubmersible drilling rig and the controllably buoyant structure shown in SU 1303486 would be unsuitable as a permanent floating production facility located in a geographic area subject to severe sea states.

Thus there is a requirement for a buoyant platform which is capable of continued operation in more severe sea states than can be tolerated by semisubmersible vessels currently in use. This may be combined with a further requirement for oil storage at an open sea site.

In some cases there may be a requirement to add production facilities to a semisubmersible vessel which is already equipped with power supplies and drilling equipment. Deck load and area limitations, which would normally prevent such production equipment from being carried, can be overcome by supporting the semisubmersible vessel on a raft.

The invention provides a floating platform comprising in combination a semisubmersible vessel having two or more pontoons, buoyant columns upstanding from those pontoons and a deck supported on the columns (the semisubmersible vessel being of a kind known per se); and a raft comprising a hull portion and two or more buoyant caissons arranged so that the raft is capable of floating in a stable configuration with the hull portion of the raft submerged to such a depth that the semisubmersible vessel can float over the hull portion and with only the buoyant caissons piercing the water surface, in which the pontoons of the semisubmersible vessel are secured to upper surfaces of the hull of the raft.

A raft of the kind described in the preceding paragraph will hereinafter be referred to as a raft "of the kind described".

Advantageously the buoyant caissons are disposed at or near the lateral extremities of the raft.

It is preferred that the raft has compartments for the storage of oil, and in this preferred from there may be provision for counter flooding to compensate for the accumulation or depletion of oil within the raft.

It is also preferred that two adjacent buoyant caissons are extended upwardly to above sea level and adapted to carry an additional deck area.

In one preferred form the raft has mooring equipment, whereby an array of moorings can be deployed from those caissons.

In another preferred form the raft is connected to the seabed by vertical tensioned tethers.

Advantageously the vertical depth of the raft may be less at points on the periphery of the raft than it is at the centre of the raft.

Either or both of the upper and lower surfaces of the raft may slope upwardly or downwardly (as the case may be) from the edge of the raft towards the centre of the raft.

Peripheral edges of the raft may be profiled to reduce resistance to wave and/or current loads.

The invention also provides a method of assembly of a platform as described above comprising the steps of deballasting a semisubmersible vessel so that it floats on its pontoons, ballasting a raft (of the kind described) so that the upper surface of its hull is submerged to a depth greater than the deballasted draft of the vessel, floating the vessel over the hull of the raft, deballasting the raft so that the pontoons of the vessel are raised above water level, and then securing the vessel to the upper surface of the hull of the raft.

Two specific embodiments of the invention will now be described by way of example with reference to the accompanying drawings in which.

Figure 1:
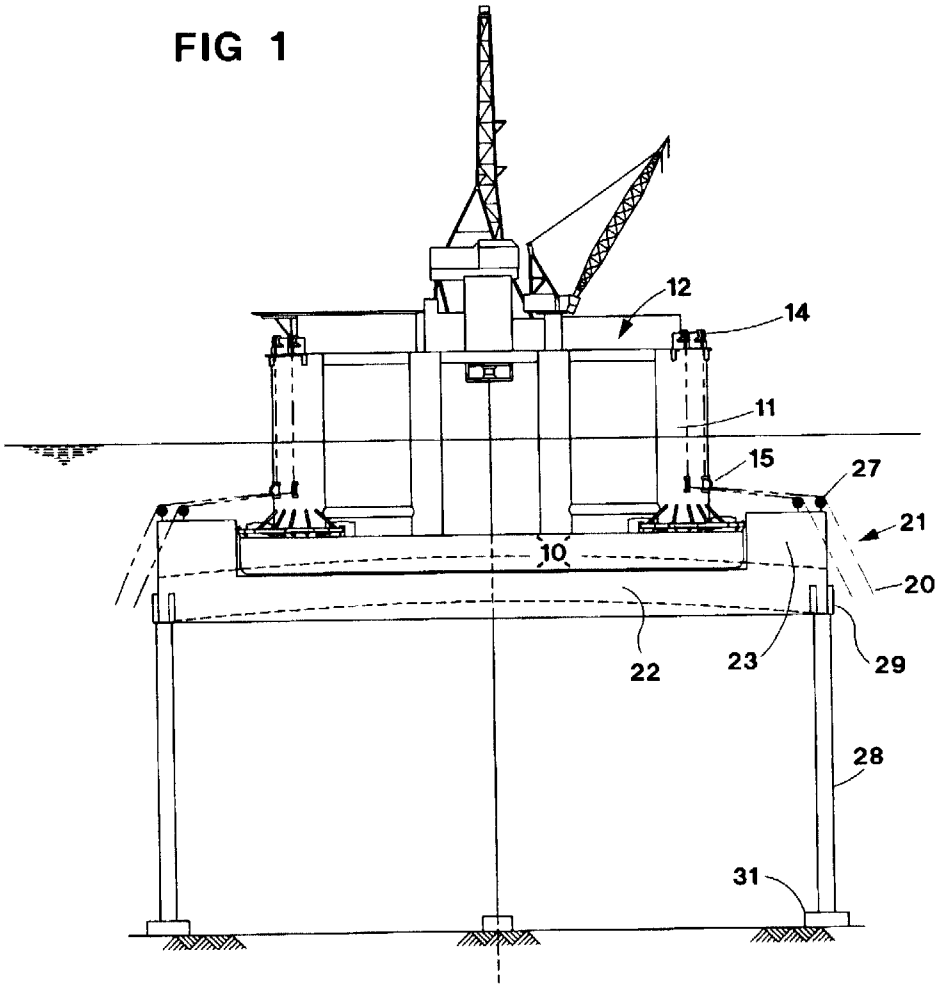
FIG. 1 is a side view of a buoyant platform.

As shown in FIG. 1, a floating platform includes a generally conventional semisubmersible drilling vessel, which is frequently referred to in the offshore industry as a Mobile Offshore Drilling Unit or MODU. This MODU has two elongate pontoons 10, eight buoyant columns 11 upstanding from those pontoons, and a deck 12 supported on the columns. The pontoons 10 are subdivided internally into selectively ballastable watertight compartments. The MODU has anchor chain lockers within its corner columns, and there are winches 14 on the tops of those columns and fairleaders 15 near the bases of those columns for deploying mooring arrays.

The MODU illustrated by way of example is in fact a SEDCO 700 series semisubmersible drilling vessel, of which some fifteen were located worldwide in various operating roles at the time of making this application.

Following the invention, the MODU is secured to a purpose built raft 21. The raft has a generally flat hull 22 with a rectangular planform larger that the planform of the MODU. The hull 22 has four caissons 23 at its corners, and these caissons stand slightly higher above the upper surface of the hull 22 than the vertical draft of the pontoons 10 of the MODU in their deballasted condition.

In the simplest form of the invention, the MODU is secured to the upper surface of the hull 22 between the four corner caissons 23. In this way the raft 21 gives additional buoyancy to the MODU, and also improves the stability characteristics of the MODU. Fixing the MODU to the raft reduces the wave loads applied to the MODU, because these loads are reacted largely by the raft. Thus fatigue lives in structural elements of the MODU will be significantly improved.

The raft 21 may have internal compartments for ballast water and the storage of oil. These compartments are not shown in detail in the Figures, but if the raft were to be made of steel, these would be constructed like conventional compartments of an ocean going VLCC (Very Large Crude Carrier). If the raft were to be made of concrete, the compartments would be formed like cells in a conventional concrete gravity based fixed offshore platform. To compensate for changes in buoyancy, counter flooding arrangements would be necessary in steel rafts, so that sea water would replace or be replaced by oil as the compartments were emptied or filled. Because of the large mass of a concrete raft, counterflooding may not be necessary. However, if dry oil storage was adopted, it may be necessary to fill the tops of the storage compartment with an inert gas.

Figure 2:
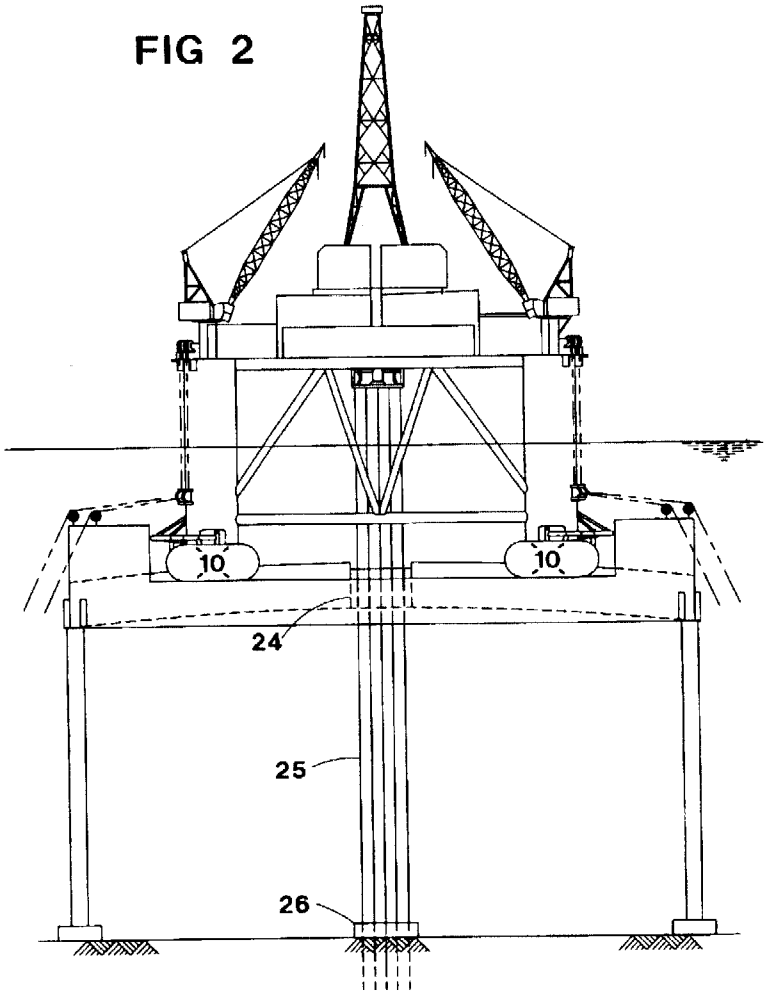
FIG. 2 is an end view of that platform.

The raft 21 may have a central moonpool 24 through which rigid or flexible riser systems 25 can be run to the seabed, as shown particularly in FIG. 2. In this case the floating platform will be required to remain on location over a drilling template or production manifold 26.

Two alternative methods of keeping the platform on location are illustrated. In the first method (shown in chain dotted lines) conventional wire or chain mooring lines 20 are deployed by the MODU from the winches 14, through the fairleaders 15, and then through additional fairleaders 27 on the tops of the caissons 23. These mooring lines 20 are set out to a conventional eight or twelve anchor mooring array (not shown).

In the second method of keeping the platform on location, it is held down against the action of its own buoyancy in the manner of a Tension Leg Platform or TLP. In this case tethers 28 (shown in full lines) extend down from tensioning devices 29 beneath the caissons 23 to tether foundation templates 31 on the seabed.

In the third method of keeping the platform on location (not illustrated) the platform is fitted with Dynamic Positioning equipment, so that neither the mooring lines 20 nor the tethers 28 will be necessary.

In a variation of the basic configuration of the raft, the hull 22 may be slightly dome shaped (as shown in dashed lines in FIG. 1), so that its draft at its centre is less than its draft around its periphery. With a dome shaped raft, the platform will ride the waves better, and so in theory a smaller air gap would be required between the nominal sea level and the lowest elements of the deck.

Turning now to the construction and assembly of the platform, many MODU's already exist which could be used as the upper part of the platform. The purpose built raft 21 is of simple construction, and could be built in sections in conventional shipyards and then assembled in sheltered water. Alternatively, the raft could be formed in concrete in the manner of a base for a concrete gravity platform. Using conventional shipbuilding or concrete pouring techniques, the raft (with internal compartments for the storage of oil) could be constructed and assembled very economically.

To assemble the complete platform, the raft 21 would be ballasted down so that only the tops of the caissons 23 were above sea level. The MODU would be de-ballasted so that it floated only on its pontoons 10, and would then be positioned over the raft 21. The raft 21 would be deballasted so that its upper surface was above sea level and the MODU was clear of the water. In this condition, the MODU could be secured to the upper surface of the raft.

Figure 4:
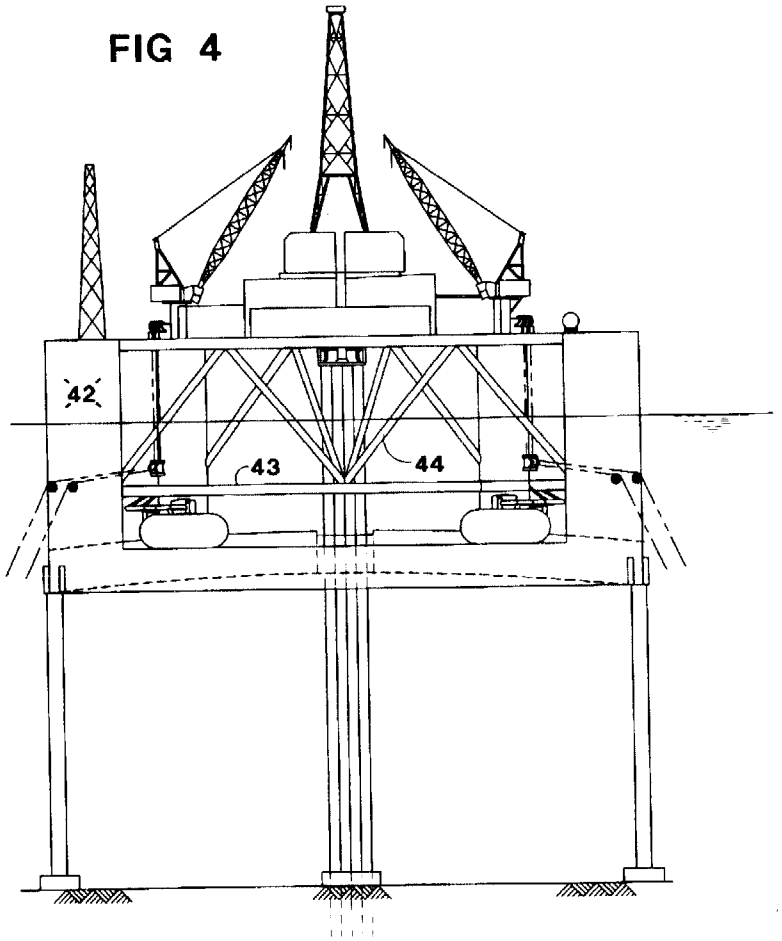
FIG. 4 is an end view of the platform shown in FIG. 3.
Figure 3:
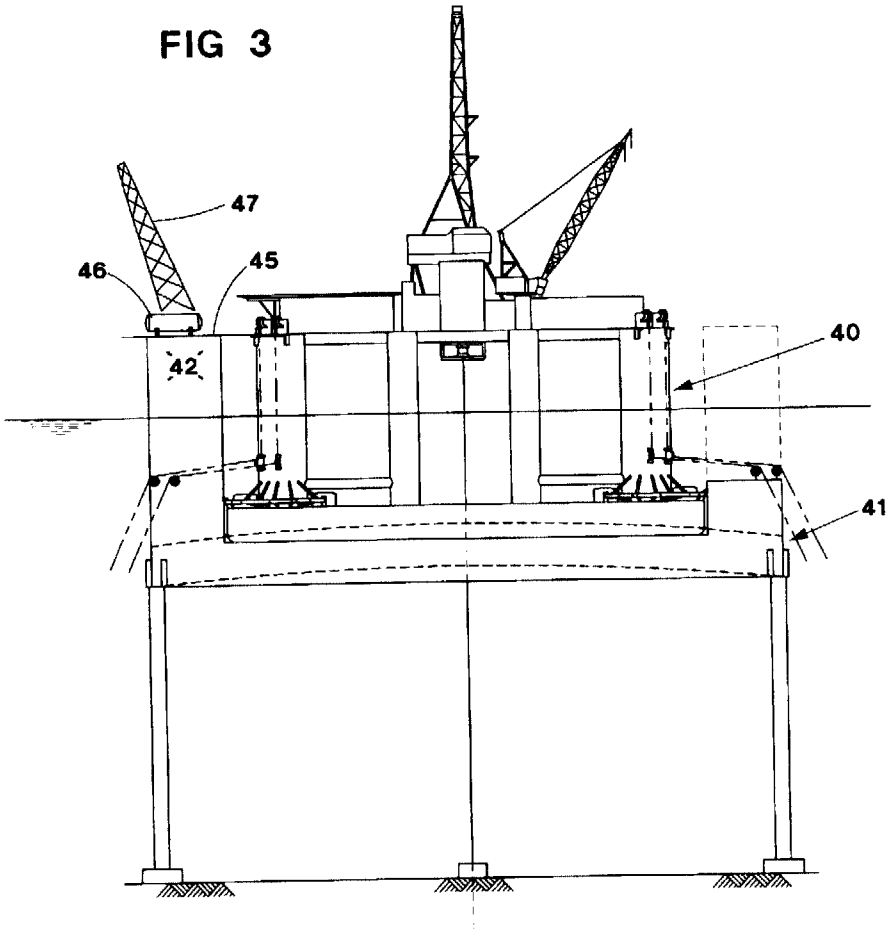
FIG. 3 is a side view of another buoyant platform.

Turning now to FIGS. 3 and 4, which illustrate a second embodiment of the invention; there show a MODU on a raft 41. In this case there is a requirement for additional production facilities, for which there is no deck space on the MODU. To meet this requirement two caissons 42 of the raft 41 are extended up to a height well above water level. The caissons 42 are joined by a tie member 43 and bracing 44, and support an additional deck area 45. Additional process elements 46 and a flare boom 47 may be mounted on the additional deck 45.

In the embodiment shown in FIGS. 3 and 4, the raft 41 has been constructed to provide buoyancy and support for an additional deck (45) adjacent to one end of the MODU. If necessary an additional deck can also be formed at the other end of the MODU as shown in dashed lines.

Many modifications are possible within the scope of the invention. As mentioned earlier the raft may also be constructed of concrete. This may be a preferred embodiment by a semisubmersible platform of steel. Theoretically of course, a semisubmersible platform made of concrete may also be combined with the raft. The most advantageous and optimal solution would be a floatable platform with steel columns, combined with a concrete raft.

Further the pontoons of the platform may be separate pontoons or buoyancy compartments, or they may be combined to an annular or rectangular unitary body or a body with another suitable form. The body may be divided in cells as explained above.

The raft may have any convenient form which is suitable for positioning the column section of the platform. Thus, it may also be constructed as an annular raft with circular, oval or rectangular form open in the center area. The sites for positioning the columns of the floating platform on the raft may also be especially prepared for this purpose, and adapted for securing the platform columns.

I claim:

1. A floating platform to be moored permanently offshore for use as a floating production facility, and comprising in combination a semisubmersible vessel having two or more pontoons, buoyant columns upstanding from the pontoons and a deck supported on the columns; and a controllably buoyant structure disposed beneath the semisubmersible vessel and capable of raising the vessel, in which the controllably buoyant structure is a raft comprising a hull portion having a projected area in plan greater than the projected area in plan of the vessel and two or more discrete buoyant caissons disposed near corners of the raft wherein the buoyant caissons stand slightly higher above the upper surface of the hull portion than the vertical draft of the pontoons of the semisubmersible vessel in its unballasted condition, and the pontoons of the semisubmersible vessel are permanently secured to upper surfaces of the hull portion of the raft, so that the combination of semisubmersible vessel and controllably buoyant structure form a permanent offshore floating production facility.

2. A floating platform as claimed in claim 1 in which the hull portion of the raft has compartments for the storage of oil, and there is provision for counterflooding to compensate for the accumulation or depletion of oil within the raft.

3. A floating platform as claimed in claim 1 in which the caissons at the corners of the raft have mooring equipment to secure the platform on station, so that mooring loads are carried in the raft.

4. A floating platform as claimed in claim 3 in which the mooring equipment, comprises an array of catenary moorings which can be deployed from the caissons.

5. A floating platform as claimed in claim 3 in which the mooring equipment comprises vertical tensioned tethers which can be deployed from the caissons.

6. A floating platform to be moored permanently offshore for use as a floating production facility, and comprising in combination a semisubmersible vessel having two or more pontoons, buoyant columns upstanding from the pontoons and a deck supported on the columns; and a controllably buoyant structure disposed beneath the semisubmersible vessel and capable of raising the vessel, in which the controllably buoyant structure is a raft comprising a hull portion having a projected area in plan greater than the projected area in plan of the vessel and two or more discrete buoyant caissons disposed near corners of the raft wherein the buoyant caissons stand slightly higher above the upper surface of the hull portion than the vertical draft of the pontoons of the semisubmersible vessel in its unballasted condition, and the pontoons of the semisubmersible vessel are permanently secured to upper surfaces of the hull portion of the raft, so that the combination of semisubmersible vessel and controllably buoyant structure form a permanent offshore floating production facility, and in which two adjacent buoyant caissons of the raft are extended upwardly to above sea level and adapted to carry an additional deck area which is connected to the deck of the semisubmersible vessel.

7. A floating platform to be moored permanently offshore for use as a floating production facility, and comprising in combination a semisubmersible vessel having two or more pontoons, buoyant columns upstanding from the pontoons and a deck supported on the columns; and a controllably buoyant structure disposed beneath the semisubmersible vessel and capable of raising the vessel, in which the controllably buoyant structure is a raft comprising a hull portion having a projected area in plan greater than the projected area in plan of the vessel and two or more discrete buoyant caissons disposed near corners of the raft wherein the buoyant caissons stand slightly higher above the upper surface of the hull portion than the vertical draft of the pontoons of the semisubmersible vessel in its unballasted condition, and the pontoons of the semisubmersible vessel are permanently secured to upper surfaces of the hull portion of the raft, so that the combination of semisubmersible vessel and controllably buoyant structure form a permanent offshore floating production facility, in which either or both of the upper and lower surfaces of the raft slope upwardly or downwardly respectively from the edge of the raft towards the center of the raft.

8. A method of assembly of a floating platform comprising in combination a semisubmersible vessel having two or more pontoons, buoyant columns upstanding from the pontoons and a deck supported on the columns, and a controllably buoyant structure disposed beneath the semisubmersible vessel and capable of raising the vessel, the method comprising the steps of deballasting the semisubmersible vessel so that it floats on its pontoons, ballasting the controllably buoyant structure comprising a raft so that the upper surface of its hull portion is submerged to a depth greater than the deballasted draft of the vessel, floating the vessel over the hull portion of the raft and between discrete buoyant caissons at corners of the raft, deballasting the raft so that the pontoons of the vessel are raised above water level, and then securing the vessel permanently to the upper surface of the hull portion of the raft, so that the combined strength of the platform is greater than the strength of either the semisubmersible vessel or the controllably buoyant structure, such that the platform is able to withstand severe wave action over extended periods of time.

* * * * *